US008509640B2

(12) United States Patent
Sato

(10) Patent No.: US 8,509,640 B2
(45) Date of Patent: Aug. 13, 2013

(54) IMAGE FORMING APPARATUS WITH CONTROL UNIT

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1024 days.

(21) Appl. No.: 12/010,346

(22) Filed: Jan. 24, 2008

(65) Prior Publication Data

US 2008/0181643 A1 Jul. 31, 2008

(30) Foreign Application Priority Data

Jan. 26, 2007 (JP) ..... 2007-016120

(51) Int. Cl.
*G03G 15/20* (2006.01)

(52) U.S. Cl.
USPC ..... 399/69; 399/70

(58) Field of Classification Search
USPC ..... 399/69, 70
See application file for complete search history.

(56) References Cited

U.S. PATENT DOCUMENTS

| | | | | |
|---|---|---|---|---|
| 6,397,021 | B2 * | 5/2002 | Hayashi et al. | 399/69 |
| 6,768,882 | B2 * | 7/2004 | Omoto et al. | 399/69 |
| 7,242,881 | B2 * | 7/2007 | Taki et al. | 399/45 |
| 2003/0123893 | A1 * | 7/2003 | Fukano et al. | 399/69 |
| 2005/0163524 | A1 * | 7/2005 | Shiobara et al. | 399/69 |
| 2007/0154230 | A1 * | 7/2007 | Choi | 399/69 |

FOREIGN PATENT DOCUMENTS

| | | |
|---|---|---|
| JP | 07-219386 | 8/1995 |

* cited by examiner

*Primary Examiner* — David Gray
*Assistant Examiner* — Andrew Do
(74) *Attorney, Agent, or Firm* — Kubotera & Associates LLC

(57) ABSTRACT

An image forming apparatus includes a fixing member; a pressing member abutting against the fixing member; a first temperature detection unit for detecting a temperature of the fixing member; a heating member for heating the fixing member; a power control unit for controlling power supplied to the heating member; a drive unit for rotating the fixing member; and a control unit for controlling the power control unit and the drive unit according to the temperature of the fixing member and a temperature of the pressing member before the fixing member rotates.

8 Claims, 11 Drawing Sheets

IMAGE FORMING APPARATUS WITH CONTROL UNIT

BACKGROUND OF THE INVENTION AND RELATED ART STATEMENT

The present invention relates to an image forming apparatus.

In a conventional image forming apparatus such as a printer, a copier, a fax machine, and a multifunction product thereof, a toner image is formed according to an image. Then, the toner image is transferred to a sheet, and is fixed to the sheet through heating and pressing the sheet.

In the conventional image forming apparatus, a heat source may not be disposed in a pressing roller of a fixing device for reducing power consumption of a printer or a cost thereof. In such a printer, when a print command is received, a fixing roller and the pressing roller rotate for a specific period of time for warming up. Afterward, a temperature of the fixing roller is detected to confirm whether the detected temperature is within a specific range capable of fixing or a fixing enable temperature range. When it is confirmed that the temperature of the fixing roller is within the fixing enable temperature range, an operation of forming an image or a printing operation is started (refer to Patent Reference).

Patent Reference: Japanese Patent Publication No. 07-219386

In the conventional printer, when the printing operation described above is performed, it is difficult to obtain high print throughput representing throughput of forming an image. Accordingly, a time for warming up needs to be shortened, or the printing operation may be performed without warming up. In this case, after the printing operation is started, a problem such as cold offset may occur in the fixing device, thereby lowering image quality.

In the view of the problems described above, an object of the present invention is to provide an image forming apparatus capable of solving the problems of the conventional printer. In the image forming apparatus, it is possible to obtain high print throughput and improve image quality.

Further objects and advantages of the invention will be apparent from the following description of the invention.

SUMMARY OF THE INVENTION

In order to attain the objects described above, according to the present invention, an image forming apparatus includes a fixing member; a pressing member abutting against the fixing member; a first temperature detection unit for detecting a temperature of the fixing member; a heating member for heating the fixing member; a power control unit for controlling power supplied to the heating member; a drive unit for rotating the fixing member; and a control unit for controlling the power control unit and the drive unit according to the temperature of the fixing member and a temperature of the pressing member before the fixing member rotates.

In the present invention, the image forming apparatus includes the fixing member; the pressing member abutting against the fixing member; the first temperature detection unit for detecting the temperature of the fixing member; the heating member for heating the fixing member; the power control unit for controlling power supplied to the heating member; the drive unit for rotating the fixing member; and the control unit for controlling the power control unit and the drive unit according to the temperature of the fixing member and the temperature of the pressing member before the fixing member rotates.

In particular, the control unit controls the power control unit and the drive unit according to the temperature of the fixing member and the temperature of the pressing member before the fixing member rotates. Accordingly, it is possible to prevent a problem such as cold offset and improve image quality.

Further, when the temperature of the fixing member is within a fixing enable temperature range, it is possible to immediately start a printing operation without warming up. Accordingly, it is possible to reduce power consumption of the image forming apparatus and increase throughput of forming an image.

DETAILED DESCRIPTION OF THE PREFERRED EMBODIMENTS

Hereunder, embodiments of the present invention will be explained with reference to the accompanying drawings. In the description below, a printer is described as an example of an image forming apparatus.

First Embodiment

Figure 2:
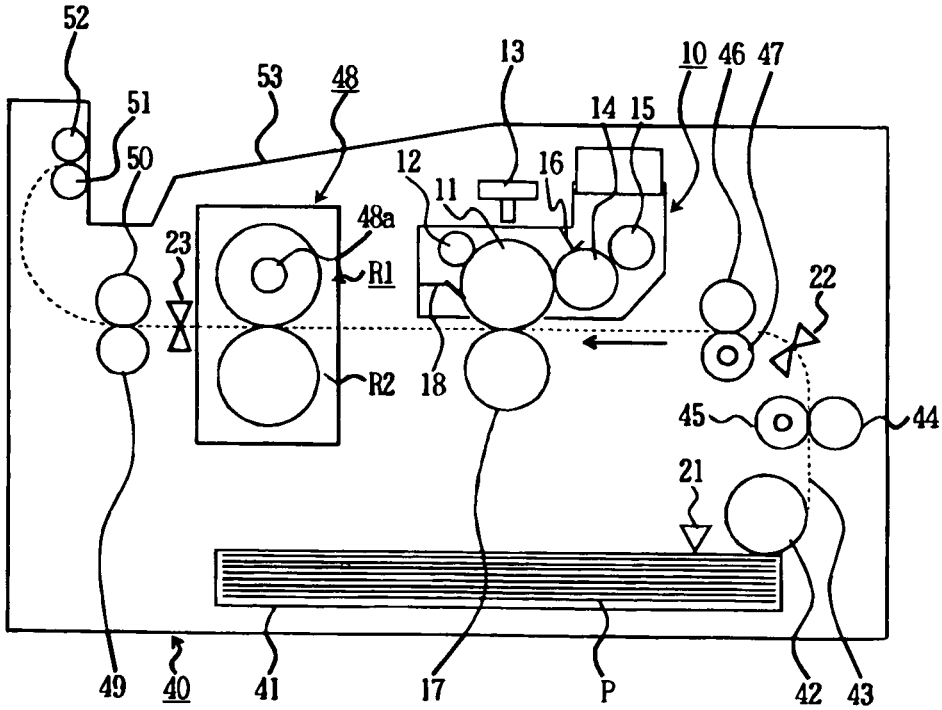
FIG. 2 is a schematic view showing a printer according to the first embodiment of the present invention.

A first embodiment of the present invention will be explained. FIG. 2 is a schematic view showing a printer 40 according to the first embodiment of the present invention.

As shown in FIG. 2, the printer 40 is provided with a sheet cassette 41 for storing a sheet P as a medium; an image forming unit 10 (ID unit) for forming a toner image as a developer image; and a fixing device 48 as a fixing unit. A hopping roller 42 is disposed at a front end portion of the sheet cassette 41 for separating the sheet P one by one and transporting the sheet P to a sheet transportation path 43.

When the hopping roller 42 picks up and transports the sheet P in an arrow direction, pinch rollers 44 and 45 disposed on a downstream side of the hopping roller 42 in the transportation path 43 transport the sheet P. Then, a resister, roller 46 and a transportation roller 47 disposed on a downstream side of the pinch rollers 44 and 45 in the transportation path 43 transport the sheet P to the image forming unit 10.

In the embodiment, the image forming unit 10 includes a photosensitive drum 11 as an image supporting member. An LED (Light Emitting Diode) head 13 is disposed at an upper portion of the image forming unit 10 to face the photosensitive drum 11 for forming a static latent image on a surface of the photosensitive drum 11. A transfer roller 17 as a transfer member is disposed at a lower portion of the image forming unit 10 to face the photosensitive drum 11 for transferring a toner image as a developer image formed on the surface of the photosensitive drum 11 to the sheet P.

In the embodiment, the image forming unit 10 further includes a charging roller 12 as a charging device for uniformly and evenly charging the surface of the photosensitive drum 11; a developing roller 14 as a toner supporting member for attaching toner as developer to the static latent image to form the toner image; a toner supply roller 15 as a developer supply member for charging and supplying toner to the developing roller 14; a developing blade 16 for forming a toner layer as a developer layer on the developing roller 14; and a cleaning blade 18 as a cleaning device for collecting toner remaining on the photosensitive drum 11 after the toner image is transferred.

In the image forming unit 10, the charging roller 12, the developing roller 14, the transfer roller 17, and the cleaning blade 18 are arranged to contact with the photosensitive drum 11. Further, the developing blade 16 and the toner supply roller 15 are arranged to contact with the developing roller 14.

In the embodiment, the fixing device 48 is disposed in the sheet transportation path 43 on a downstream side of the image forming unit 10 and the transfer roller 17. The fixing device 48 includes a fixing roller R1 as a fixing member or a first rotational member and a pressing roller R2 as a pressing member or a second rotational member. A heat source 48*a* as a heating member such as a halogen lamp is disposed in the fixing roller R1. Discharge rollers 49 to 52 are disposed in the sheet transportation path 43 on a downstream side of the fixing device 48 for discharging the sheet P to a stacker portion 53 as a medium placing portion.

In the embodiment, a sheet remaining amount sensor 21 as a first medium detection unit is disposed to face the sheet cassette 41 for detecting a remaining amount of the sheet P in the sheet cassette 41. A writing sensor 22 as a second medium detection unit is disposed in the sheet transportation path 43 on a downstream side of the pinch rollers 44 and 45 and an upstream side of the resister roller 46 and the transportation roller 47 for detecting whether the sheet P arrives. A discharge sensor 23 as a second medium detection unit is disposed in the sheet transportation path 43 on a downstream side of the fixing device 48 and an upstream side of the discharge rollers 49 and 50 for detecting whether the sheet P arrives.

Figure 3:
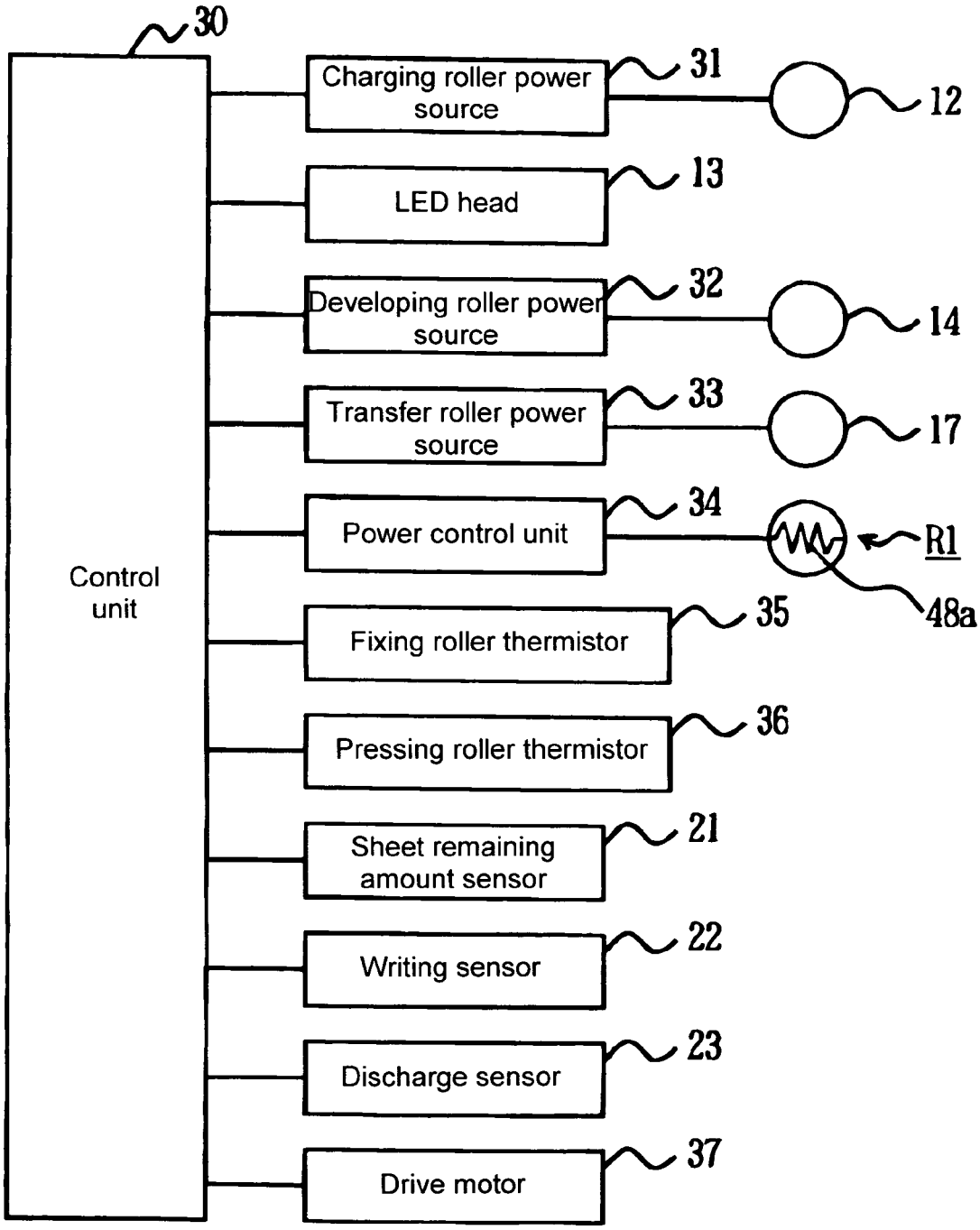
FIG. 3 is a block diagram showing a printer control unit according to the first embodiment of the present invention.

A printer control unit will be explained next. FIG. 3 is a block diagram showing the printer control unit according to the first embodiment of the present invention.

As shown in FIG. 3, the printer control unit includes a control unit 30 as a print control unit; the charging roller 12; a charging roller power source 31; the LED head 13; the developing roller 14; a developing roller power source 32; the transfer roller 17; a transfer roller power source 33; the fixing roller R1 with the heat source 48*a*; a power control unit 34; a fixing roller thermistor 35 as a first temperature detection unit; a pressing roller thermistor 36 as a second temperature detection unit; the sheet remaining amount sensor 21; the writing sensor 22; the discharge sensor 23; a drive motor 37 as a drive unit of the fixing device 48; and the likes.

In the embodiment, the control unit 30 includes a CPU (not shown); a storage unit (ROM, EEPROM or rewritable non-volatile memory, RAM, and the likes); an input-output port; a timer; and the likes. The control unit 30 is connected to a host device such as a computer, and controls an operation of the printer 40 (FIG. 2). Further, the control unit 30 performs a printing operation according to image data (video signal) including a control signal sent from the host device, data having bit map data arranged in a line, and the likes.

In the embodiment, the control unit 30 is further connected to the charging roller power source 31; the LED head 13; the developing roller power source 32; the transfer roller power source 33; the power control unit 34; the fixing roller thermistor 35; the pressing roller thermistor 36; the sheet remaining amount sensor 21; the writing sensor 22; the discharge sensor 23; and the drive motor 37. Further, the charging roller 12 is connected to the charging roller power source 31. The developing roller 14 is connected to the developing roller power source 32, and the transfer roller 17 is connected to the transfer roller power source 33. Further, the heat source 48*a* is connected to the power control unit 34, so that the power control unit 34 controls power to the heat source 48*a*.

Figure 1:
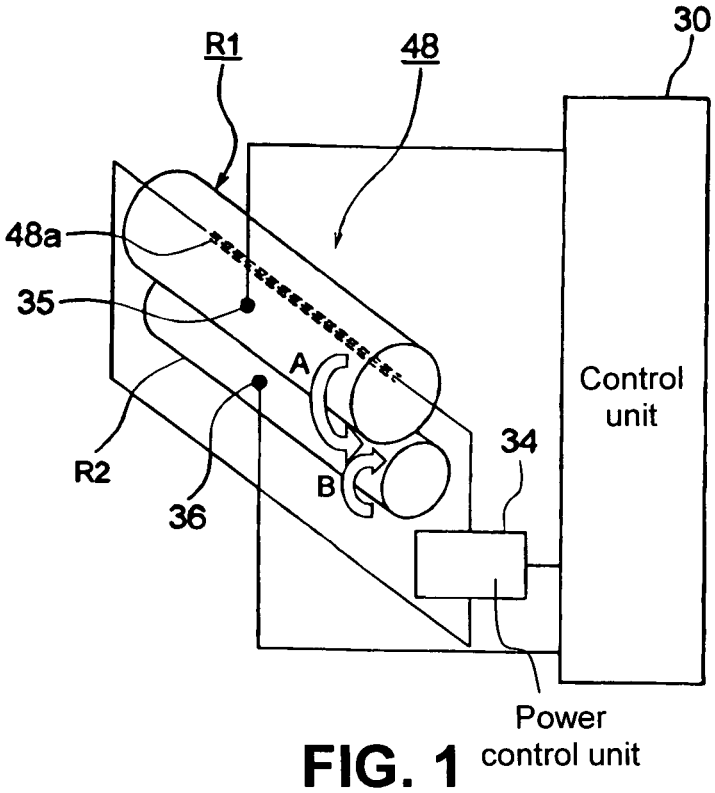
FIG. 1 is a schematic view showing a fixing device control system according to a first embodiment of the present invention.

A fixing device control system will be explained next. FIG. 1 is a schematic view showing the fixing device control system according to the first embodiment of the present invention.

As shown in FIG. 1, the fixing device control system includes the heat source 48*a*; the fixing device 48 having the fixing roller R1 and the pressing roller R2; the fixing roller thermistor 35; and the pressing roller thermistor 36. The fixing roller thermistor 35 and the pressing roller thermistor 36 may be a contact type or a non-contact type. The fixing roller thermistor 35 and the pressing roller thermistor 36 are connected to the control unit 30. The heat source 48*a* is connected to the power control unit 34, and the power control unit 34 is connected to the control unit 30.

In the embodiment, the heat source 48*a* is disposed in the fixing roller R1, so that heat generated from the heat source 48*a* is uniformly conducted to a whole portion of the fixing roller R1. The drive motor 37 (FIG. 3) is driven to rotate the fixing roller R1 in, for example, an arrow direction A. In order to heat the fixing roller R1, instead of the halogen lamp, a ceramic heater may be used as the heat source 48*a*.

In the embodiment, the pressing roller R2 abuts against the fixing roller R1, and is arranged such that a shaft (rotational shaft) of the pressing roller R2 is aligned with a shaft (rotational shaft) of the fixing roller R1. Further, the pressing roller R2 is connected to the fixing roller R1 through a connection mechanism (not shown). Accordingly, when the fixing roller R1 rotates, the pressing roller R2 rotates in, for example, an arrow direction B opposite to the rotational direction of the fixing roller R1.

In the embodiment, the fixing roller thermistor 35 is a contact type or a non-contact type sensor for detecting a temperature (surface temperature) of the fixing roller R1. Similarly, the pressing roller thermistor 36 is a contact type or a non-contact type sensor for detecting a temperature (surface temperature) of the pressing roller R2. The power control unit 34 switches a power state of the heat source 48*a* according to a direction from the control unit 30. That is, the power control unit 34 turns on or off the power of the heat source 48*a*, so that the surface temperature of the fixing roller R1 detected with the fixing roller thermistor 35 is maintained within a specific range, for example, 170±10° C.

When the surface temperature of the fixing roller R1 detected with the fixing roller thermistor 35 becomes higher than the specific range, the power control unit 34 turns off the power of the heat source 48*a* according to the direction from the control unit 30. When the surface temperature of the fixing roller R1 detected with the fixing roller thermistor 35 becomes lower than the specific range, the power control unit 34 turns on the power of the heat source 48*a* according to the direction from the control unit 30.

Accordingly, when the toner image is transferred to the sheet P (FIG. 2), and the sheet P is transported to the fixing device 48, the fixing roller R1 and the pressing roller R2 heat and press the toner image, so that the toner image on the sheet P is melted and fixed. At this time, the fixing roller R1 and the pressing roller R2 rotate to transport the sheet P in a specific direction.

An operation of the printer 40 will be explained next. When the control unit 30 detects the print command as an image forming command from the host device while monitoring the control signal, the control unit 30 controls the fixing roller thermistor 35 and the pressing roller thermistor 36 to detect the surface temperatures of the fixing roller R1 and the pressing roller R2 just before rotations thereof (before rotation). According to the surface temperatures thus detected, with a method described later, the control unit 30 determines the surface temperature of the fixing roller R1 after the fixing roller R1 and the pressing roller R2 start rotating (after rotation), thereby determining whether warming up needs to be performed.

When the surface temperature of the fixing roller R1 thus determined is within a fixing enable temperature range, the control unit 30 starts the fixing roller R1 and the pressing roller R2 to rotate. Accordingly, the printing operation is started without warming up.

The sheet remaining amount sensor 21 monitors the remaining amount of the sheet P retained in the sheet cassette 41, and sends a signal regarding the existence of the sheet P to the control unit 30. When the sheet remaining amount sensor 21 detects the sheet P, the sheet remaining amount sensor 21 sends a detection signal to the control unit 30. That is, the control unit 30 detects the existence of the sheet P in the sheet cassette 41 with the sheet remaining amount sensor 21. When the control unit 30 confirms the existence of the sheet P, the control unit 30 starts the transportation of the sheet P, so that the sheet P is transported to the printing unit in the printer 40.

In the next step, according to the direction from the control unit 30, the charging roller power source 31 generates a high voltage, for example, −1,000 V to −1,100 V. The high voltage is applied to the charging roller 12, so that the surface of the charging roller 12 is uniformly and evenly charged at, for example, −600 V. For this purpose, the charging roller 12 is formed of a semi-conductive material, and abuts against the surface of the photosensitive drum 11 while rotating.

In the next step, according to the direction from the control unit 30, the LED heat 13 exposes the surface of the photosensitive drum 11 to form the static latent image having a potential of, for example, −50 to 0 V, on the surface of the photosensitive drum 11. The LED head 13 includes an LED (Light Emitting Diode) as a light emitting element. Instead of the LED head 13, a laser radiation device may be used.

In the next step, according to the direction from the control unit 30, the developing roller power source 32 generates a high voltage, so that the high voltage is applied to the developing roller 14. As a result, the developing roller 14 charges toner with a negative potential. Accordingly, toner is supplied to the surface of the photosensitive drum 11 through an electrical attraction force, so that the static latent image is developed to form the toner image.

In the next step, according to the direction from the control unit 30, the transfer roller power source 33 generates a high voltage, for example, +2,000 V to +3,000 V. The high voltage is applied to the transfer roller 17, so that the transfer roller 17 transfers the toner image formed on the surface of the photosensitive drum 11 to the sheet P through an electrical attraction force.

When the toner image is transferred to the sheet P As described above, the sheet P is transported to the fixing device 48. In the fixing device 48, the toner image is heated and pressed, so that the toner image is fixed to the sheet P. After the toner image is fixed to the sheet P, the sheet P is discharged outside the printer 40 and stacked on the stacker 53.

Figure 4:
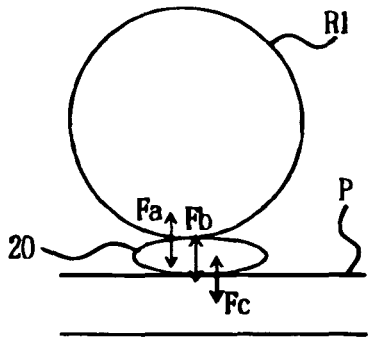
FIG. 4 is a schematic view showing a fixing roller according to the first embodiment of the present invention.

An operation of the fixing roller R1 will be explained next. FIG. 4 is a schematic view showing the fixing roller R1 according to the first embodiment of the present invention. In FIG. 4, Fa represents an attraction force between toner 20 and the fixing roller R1; Fb represents a cohesive force of the toner 20 itself; and Fc represents an attraction force between the toner 20 and the sheet P.

When the toner 20 and the sheet P receive proper heat, the attraction force Fa becomes smaller than the cohesive force Fb, and the cohesive force Fb becomes smaller than the attraction force Fc (Fa<Fb<Fc). Accordingly, the toner 20 is properly attached to the sheet P, and is permeated into the sheet P.

On the other hand, when the toner 20 and the sheet P receive excessive heat, the attraction force Fa becomes greater than the cohesive force Fb (Fa>Fb). Accordingly, the toner 20 is attached to the fixing roller R1, not to the sheet P, thereby causing image trouble or hot offset.

Further, when the toner 20 and the sheet P receive insufficient heat, the attraction force Fa becomes greater than the attraction force Fc (Fa>Fc). Accordingly, the toner 20 is not permeated into the sheet P and is detached from the sheet P, thereby causing image trouble or cold offset.

When a heat source is not disposed inside the pressing roller R2, the pressing roller R2 is heated through conductive heat from the fixing roller R1. Accordingly, when the printer 40 is turned on after being turned off for a while, the surface temperature of the pressing roller R2 becomes below the surface temperature of the fixing roller R1. In such a state, when the fixing device 48 is started, and the drive motor 37 rotates the fixing roller R1 and the pressing roller R2, heat of the fixing roller R1 is transferred to the pressing roller R2, thereby decreasing the surface temperature of the fixing roller R1.

An decrease in the surface temperature of the fixing roller R2 depends on a difference between the surface temperature of the fixing roller R1 and the surface temperature of the pressing roller R2 before the fixing roller R1 and the pressing roller R2 rotate.

An experiment of measuring the decrease in the surface temperature of the fixing roller R1 was conducted. In the experiment, it was controlled so that the surface temperature of the fixing roller R1 was maintained at a set temperature. Then, the fixing device 48 was started, and the decrease in the surface temperature of the fixing roller R1 was measured at various surface temperatures of the pressing roller R1.

Figure 5:
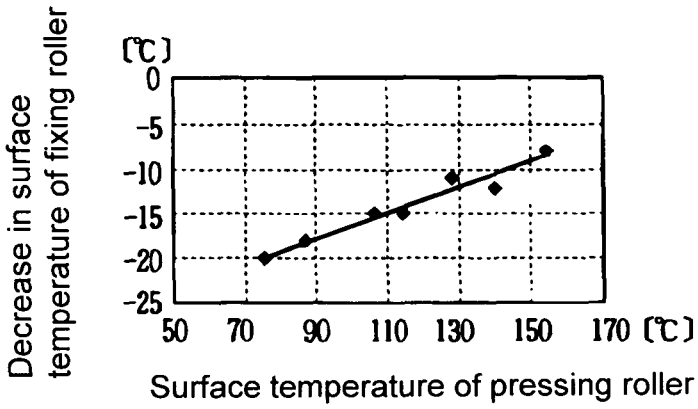
FIG. 5 is a graph showing a temperature property of the fixing roller according to the first embodiment of the present invention.

FIG. 5 is a graph showing the temperature property of the fixing roller R1 according to the first embodiment of the present invention. In FIG. 5, the horizontal axis represents the surface temperature of the pressing roller R2, and the vertical axis represents the decrease in the surface temperature of the fixing roller R1.

As shown in FIG. 5, when the pressing roller R2 has a lower surface temperature before rotation, that is, there is a larger difference between the fixing roller R1 and the pressing roller R2 before rotation, the decrease in the surface temperature of the fixing roller R1 becomes greater after rotation. This is because, even when it is controlled so that the surface temperature of the fixing roller R1 is maintained at the set temperature, it takes time for the pressing roller R2 to follow. When the printing operation is preformed in this state, a trouble such as cold offset occurs, thereby lowering image quality.

In the embodiment, when the control unit 30 (FIG. 1) receives the control signal from the host device, the control unit 30 determines whether the surface temperature of the fixing roller R1, which tends to decrease with the rotation of the fixing roller R1 and the pressing roller R2, is within the fixing enable temperature range. When the control unit 30 determines that the surface temperature of the fixing roller R1 is not within the fixing enable temperature range, the control unit 30 rotates the fixing roller R1 and the pressing roller R2 for warming up, thereby controlling the surface temperature of the fixing roller R1.

Figure 6:
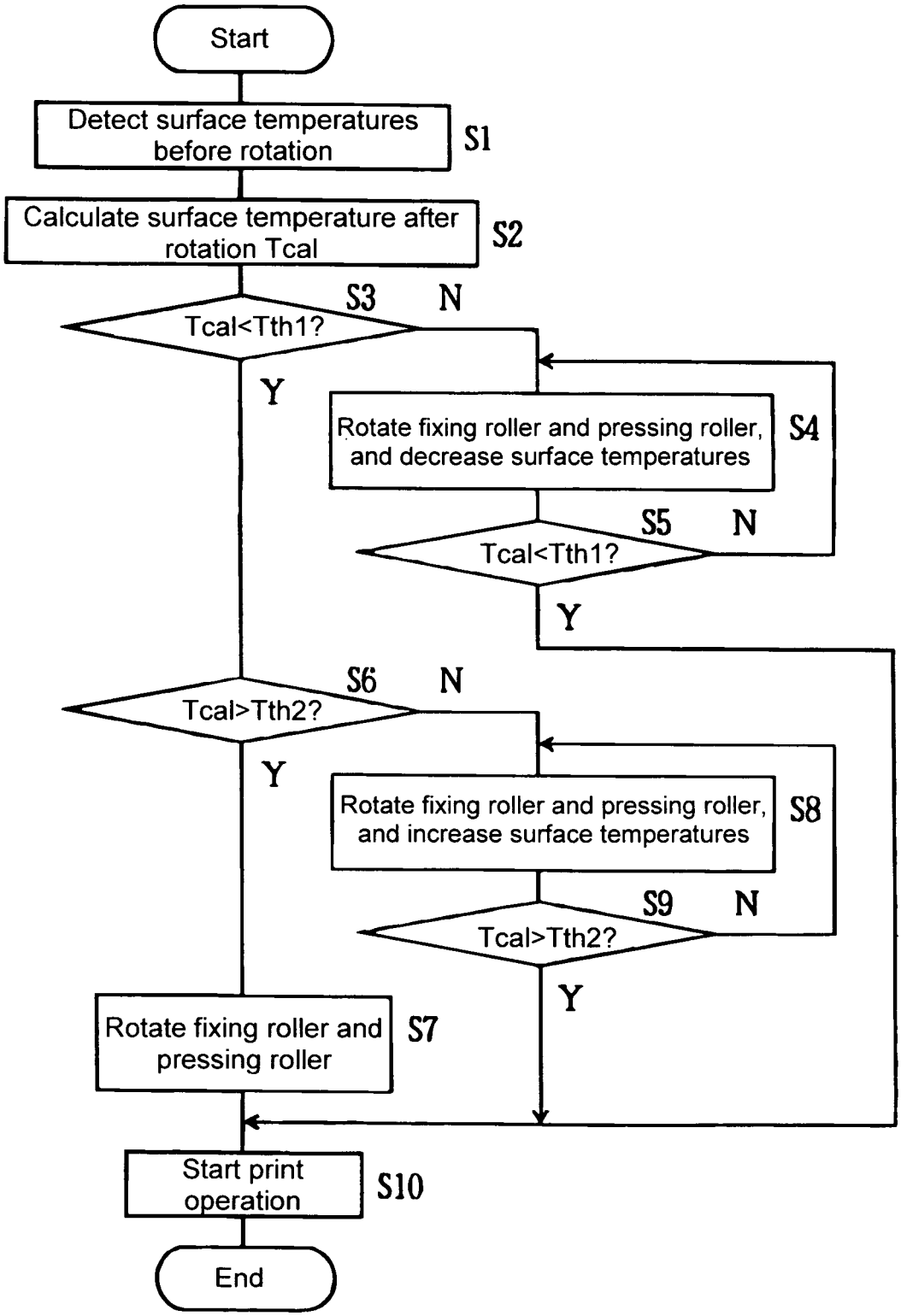
FIG. 6 is a flowchart showing an operation of a printer control unit according to the first embodiment of the present invention.

An operation of the printer control unit will be explained next. FIG. 6 is a flowchart showing the operation of the printer control unit according to the first embodiment of the present invention.

First, a command determination processing unit (not shown) of the control unit 30 (FIG. 3) performs a command determination process to determining whether the print command is received according to the control signal from the host device. When the command determination processing unit determines that the print command is received, a temperature detection processing unit (not shown) of the control unit 30 performs a temperature detection process to detect surface temperatures Tup and Tlw of the fixing roller R1 and the pressing roller R2 before rotation, respectively.

More specifically, the temperature detection processing unit reads voltages as sensor outputs of the fixing roller thermistor 35 and the pressing roller thermistor 36. Then, the temperature detection processing converts the voltages to temperatures according to a conversion formula. Note that even when the print command is received, the fixing roller R1 and the pressing roller R2 do not start immediately for warming up.

In the next step, an estimated temperature determination processing unit (not shown) of the control unit 30 performs an estimated temperature determination process. That is, the estimated temperature determination processing unit reads the surface temperatures Tup and Tlw, and calculates a surface temperature Tcal of the fixing roller R1 before rotation according to the equation (1) shown below.

$$Tcal=Tup-((Tup-Tlw)\times Ra+Rb) \quad (1)$$

where Ra and Rb (Ra=0.15, Rb=0.0) are coefficients for temperature calculation after rotation. Ra and Rb are determined through an experiment according to parameters such as a contact state between the fixing roller R1 and the pressing roller R2, heat capacities of the fixing roller R1 and the pressing roller R2, and the likes.

In the next step, a temperature determination processing unit (not shown) of the control unit 30 performs a temperature determination process to determine whether the fixing device 48 (FIG. 1) can perform the fixing operation. More specifically, the temperature determination processing unit reads the surface temperature Tcal of the fixing roller R1, and further reads a fixing enable temperature upper limit Tth1 as a first threshold value from the storage unit of the control unit 30.

Then, the temperature determination processing unit compares the surface temperature Tcal with the fixing enable temperature upper limit Tth1 to determine whether the surface temperature Tcal is below the fixing enable temperature upper limit Tth1. When the surface temperature Tcal is above the fixing enable temperature upper limit Tth1, hot offset tends to occur. Accordingly, the fixing enable temperature upper limit Tth1 is referred to as a hot offset occurrence temperature.

When the surface temperature Tcal is above the fixing enable temperature upper limit Tth1, a temperature adjustment processing unit (not shown) of the control unit 30 performs a temperature adjustment process to drive the drive motor 37 and rotate the fixing roller R1 and the pressing roller R2. Further, the temperature adjustment processing unit turns off (terminates) the power from the fixing device 48 to the heat source 48*a* to prevent the fixing roller R1 from receiving heat, thereby lowering the surface temperatures Tup and Tlw. As described above, a first warming up is performed through the steps described above.

When the surface temperature Tcal becomes below the fixing enable temperature upper limit Tth1 and within the fixing enable temperature range, a print processing unit (not shown) of the control unit 30 as an image forming processing unit performs a print process as an image forming process, thereby starting the printing operation. It is arranged such that when the printing operation starts, the hopping roller 42 picks up and transports the sheet P to the sheet transportation path 43. Note that this is just an example, and it may be arranged such that when the printing operation starts, the LED (Light Emitting Diode) head 13 exposes the surface of the photosensitive drum 11 in the image forming unit 10.

On the other hand, when the surface temperature Tcal is below the fixing enable temperature upper limit Tth1, the temperature determination processing unit reads the surface temperature Tcal, and further reads a fixing enable temperature lower limit Tth2 as a second threshold value from the storage unit of the control unit 30.

Then, the temperature determination processing unit compares the surface temperature Tcal with the fixing enable temperature lower limit Tth2 to determine whether the surface temperature Tcal is above the fixing enable temperature lower limit Tth2. When the surface temperature Tcal is below the fixing enable temperature lower limit Tth2, cold offset tends to occur. Accordingly, the fixing enable temperature lower limit Tth2 is referred to as a cold offset occurrence temperature.

When the surface temperature Tcal is above the fixing enable temperature lower limit Tth2, the surface temperature Tcal is within the fixing enable temperature range. Accordingly, the print processing unit starts to rotate the fixing roller R1 and the pressing roller R2, and immediately performs the print process without warming up.

When the surface temperature Tcal is below the fixing enable temperature lower limit Tth2, the surface temperature Tcal is not within the fixing enable temperature range. Accordingly, the temperature adjustment processing unit drives the drive motor 37 and rotates the fixing roller R1 and the pressing roller R2. Further, the temperature adjustment processing unit turns on (enables) the power from the fixing device 48 to the heat source 48*a* to heat the fixing roller R1, thereby increasing the surface temperatures Tup and Tlw. As described above, a second warming up is performed through the steps described above.

When the surface temperature Tcal is above the fixing enable temperature lower limit Tth2, the print processing unit starts the print process.

The flowchart shown in FIG. 6 will be explained next. In step S1, the surface temperatures Tup and Tlw before rotation are detected. In step S2, the surface temperature after rotation Tcal is calculated. In step S3, it is determined whether the surface temperature Tcal is below the fixing enable temperature upper limit Tth1. When the surface temperature Tcal is below the fixing enable temperature upper limit Tth1, the process proceeds to step S6. When the surface temperature Tcal is above the fixing enable temperature upper limit Tth1, the process proceeds to step S4.

In step S4, the fixing roller R1 and the pressing roller R2 rotate, and the heat source 48*a* is turned off (terminated), thereby lowering the surface temperatures Tup and Tlw. In step S5, it is determined whether the surface temperature Tcal is below the fixing enable temperature upper limit Tth1. When the surface temperature Tcal is below the fixing enable temperature upper limit Tth1, the process proceeds to step S10. When the surface temperature Tcal is above the fixing enable temperature upper limit Tth1, the process returns to step S4.

In step S6, it is determined whether the surface temperature Tcal is above the fixing enable temperature lower limit Tth2. When the surface temperature Tcal is above the fixing enable temperature lower limit Tth2, the process proceeds to step S7. When the surface temperature Tcal is below the fixing enable temperature lower limit Tth2, the process proceeds to step S8.

In step S7, the fixing roller R1 and the pressing roller R2 rotate. In step S8, the fixing roller R1 and the pressing roller R2 rotate, and the heat source 48*a* is turned on (enabled), thereby increasing the surface temperatures Tup and Tlw. In step S9, it is determined whether the surface temperature Tcal is above the fixing enable temperature lower limit Tth2. When the surface temperature Tcal is above the fixing enable temperature lower limit Tth2, the process proceeds to step S10. When the surface temperature Tcal is below the fixing enable temperature lower limit Tth2, the process returns to step S8. In step S10, the printing operation is started, thereby completing the process.

Figure 7:
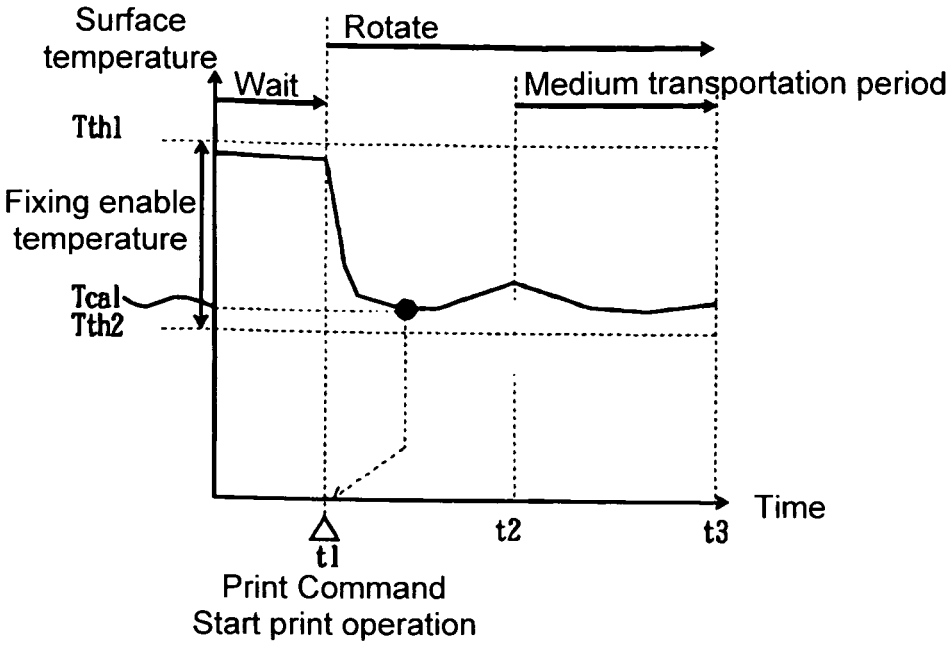
FIG. 7 is a time chart No. 1 showing an operation of the printer according to the first embodiment of the present invention.
Figure 8:
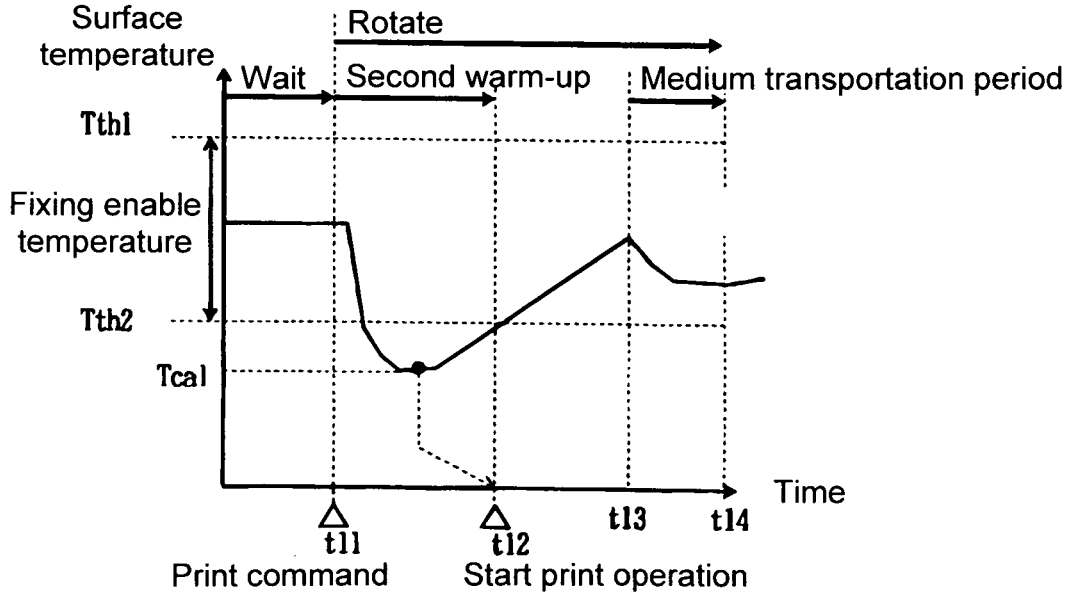
FIG. 8 is a time chart No. 2 showing the operation of the printer according to the first embodiment of the present invention.

FIG. 7 is a time chart No. 1 showing the operation of the printer 40 according to the first embodiment of the present invention. FIG. 8 is a time chart No. 2 showing the operation of the printer 40 according to the first embodiment of the present invention.

As shown in FIG. 7, when the print command is detected at a timing t1 while waiting for the print command, the surface temperature Tcal of the fixing roller R1 after rotation is calculated. In this case, the surface temperature Tcal is within the fixing enable temperature range below the fixing enable temperature upper limit Tth1 and above the fixing enable temperature lower limit Tth2. Accordingly, the fixing roller R1 and the pressing roller R2 start rotating, and the print processing unit immediately performs the print process. A period of time between a timing t2 and a timing t3 represents a medium transportation period.

As shown in FIG. 8, when the print command is detected at a timing t11 while waiting for the print command, the surface temperature Tcal of the fixing roller R1 after rotation is calculated. In this case, the surface temperature Tcal is not within the fixing enable temperature range and below the fixing enable temperature lower limit Tth2. Accordingly, the fixing roller R1 and the pressing roller R2 start rotating at the timing t11, and the second warming up is started. When the surface temperature Tcal is within the fixing enable temperature range and above the fixing enable temperature lower limit Tth2, the second warming up is completed. Then, the print processing unit performs the print process. A period of time between a timing t13 and a timing t14 represents a medium transportation period.

With the control described above, it is possible to prevent troubles such as cold offset and improve image quality.

As described above, in the embodiment, the surface temperatures Tup and Tlw of the fixing roller R1 and the pressing roller R2 before rotation are detected. Then, the surface temperature Tcal of the fixing roller R1 after rotation is calculated according to the surface temperatures Tup and Tlw. It is determined whether the warming up is performed according to the surface temperature Tcal, thereby controlling the surface temperature Tup of the fixing roller R1. Accordingly, even when the surface temperature Tlw of the pressing roller R2 is low, it is possible to prevent troubles such as cold offset and improve image quality.

Further, when the surface temperature Tcal is within the fixing enable temperature range, that is, the printing operation is in the enable state, it is possible to immediately start the printing operation, thereby conserving the power of the printer 40 (FIG. 2) and improving print throughput.

Second Embodiment

A second embodiment of the invention will be described next. In the first embodiment, when the surface temperature Tcal is below the fixing enable temperature lower limit Tth2, the second warming up is performed until the surface temperature Tcal becomes above the fixing enable temperature lower limit Tth2. Accordingly, the printing operation is not performed during the period of time. In the second embodiment, it is possible to reduce the period of time when the print command is received. Components in the second embodiment similar to those in the first embodiment are designated by the same reference numerals, and provide effects similar to those in the first embodiment.

Figure 9:
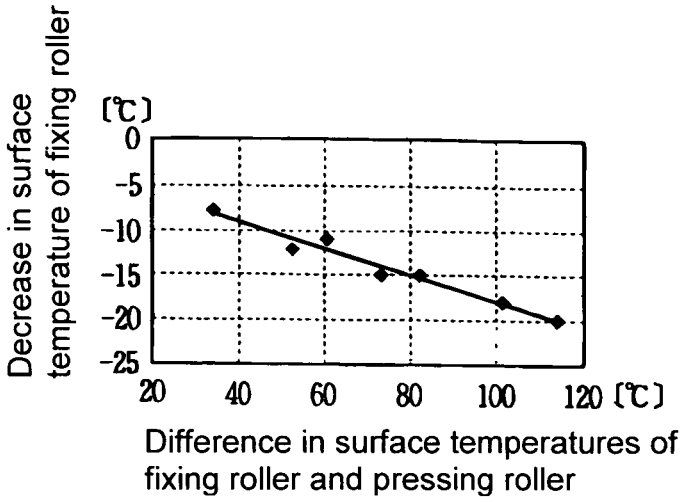
FIG. 9 is a graph showing a relationship between a difference in surface temperatures of a fixing roller and a pressing roller and a decrease in the surface temperature of the fixing roller according to a second embodiment of the present invention.

FIG. 9 is a graph showing a relationship between a difference in the surface temperatures Tup and Tlw of the fixing roller R1 and the pressing roller R2 and a decrease in the surface temperature Tup of the fixing roller R1 according to the second embodiment of the present invention. In FIG. 9, the horizontal axis represents the difference in the surface temperatures Tup and Tlw of the fixing roller R1 and the pressing roller R2 before rotation, and the vertical axis represents the decrease in the surface temperature of the fixing roller R1.

As shown in FIG. 9, when the difference in the surface temperatures Tup and Tlw of the fixing roller R1 and the pressing roller R2 becomes larger, the decrease in the surface temperature Tup of the fixing roller R1 after rotation becomes greater. This is because, even when it is controlled so that the surface temperature Tup of the fixing roller R1 is maintained at a set temperature, it takes time for the pressing roller R2 to follow. When the printing operation is preformed in this state, a trouble such as cold offset occurs, thereby lowering image quality.

In the embodiment, before receiving the control signal from the host device, the control unit 30 (FIG. 1) controls the surface temperature Tup of the fixing roller R1, which tends to decrease with the rotation of the fixing roller R1 and the pressing roller R2, to become within the fixing enable temperature range, thereby controlling the surface temperature Tup of the fixing roller R1.

Figure 10:
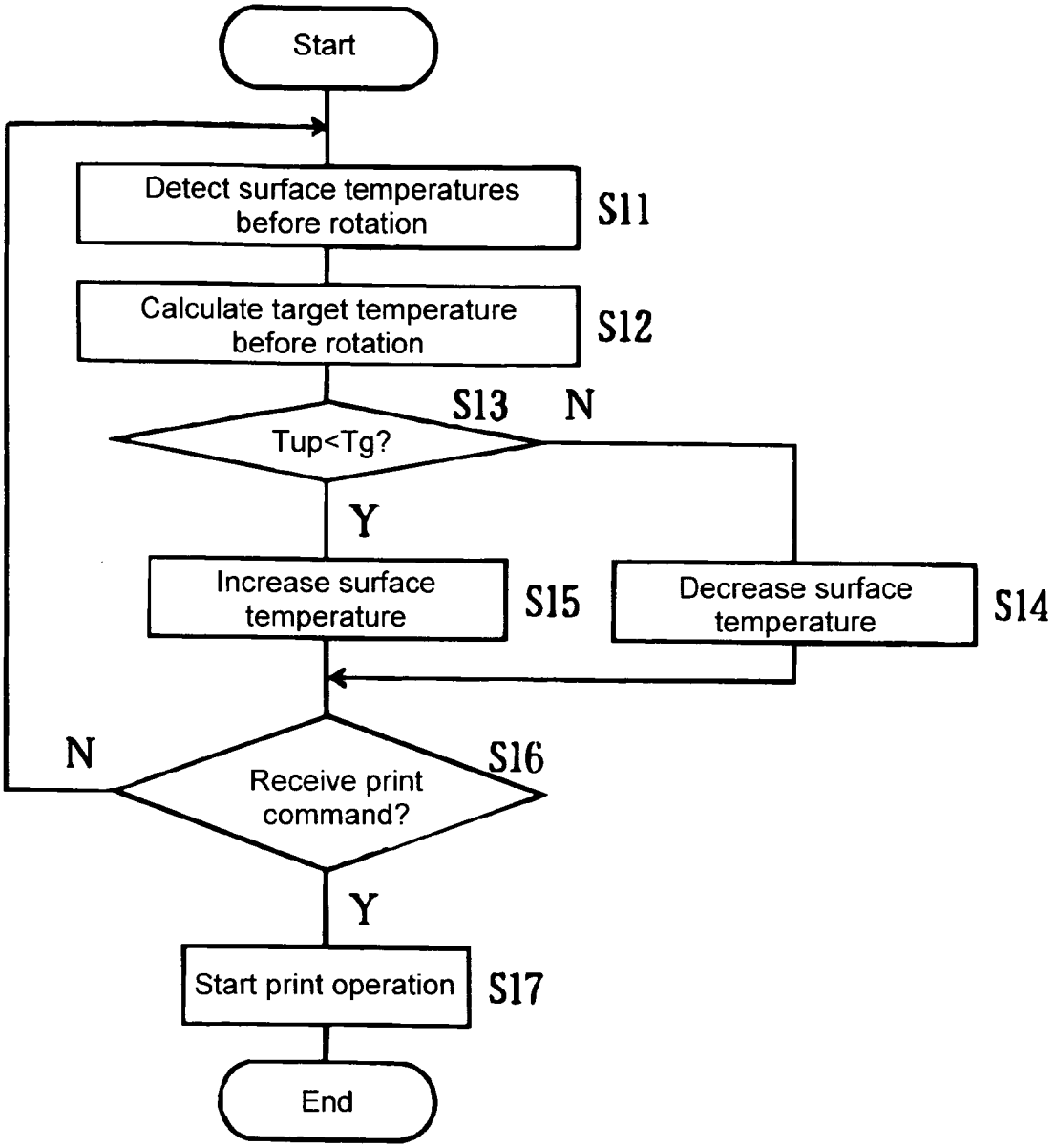
FIG. 10 is a flowchart showing an operation of a printer according to the second embodiment of the present invention.

An operation of the printer control unit will be explained next. FIG. 10 is a flowchart showing the operation of the printer according to the first embodiment of the present invention.

First, before receiving the control signal from the host device, the temperature detection processing unit (not shown) of the control unit 30 (FIG. 1) detects the surface temperatures Tup and Tlw of the fixing roller R1 and the pressing roller R2 before rotation, respectively.

It is supposed that the surface temperature Tup of the fixing roller R1 is controlled to become a target temperature (target temperature before rotation) Tg, so that the surface temperature Tup of the fixing roller R1 (surface temperature Tcal in the first embodiment) becomes a specific surface temperature Tp within the fixing enable temperature range suitable for the printing operation when the fixing roller R1 and the pressing roller R2 starts rotating from an idle state. In this case, the surface temperature Tp is given by the equation (2) shown below.

$$Tp=Tg-((Tg-Tlw)\times Ra+Rb) \quad (2)$$

Further, the target temperature before rotation Tg is given by the equation (3) shown below.

$$Tg=1/(1-Ra)\times(Tp-Tlw\times Ra+Rb) \quad (3)$$

where Ra and Rb (Ra=0.15, Rb=0.0) are the coefficients for temperature calculation after rotation. Ra and Rb are determined through an experiment according to parameters such as a contact state between the fixing roller R1 and the pressing roller R2, heat capacities of the fixing roller R1 and the pressing roller R2, and the likes.

In the next step, a target temperature calculation processing unit (not shown) of the control unit 30 performs a target temperature calculation process. More specifically, the target temperature calculation processing unit reads the surface temperatures Tup and Tlw. Then, the target temperature calculation process processing unit calculates the target temperature before rotation Tg using the equations shown above.

In the next step, it is controlled such that the surface temperature Tup of the fixing roller R1 becomes the target temperature before rotation Tg. More specifically, the temperature determination processing unit (not shown) of the control unit 30 reads the surface temperature Tup and the target temperature before rotation Tg. Then, the temperature determination processing unit compares the surface temperature Tup with the target temperature before rotation Tg to determine whether the surface temperature Tup is below the target temperature before rotation Tg.

When the surface temperature Tup is below the target temperature before rotation Tg, while the fixing roller R1 and the pressing roller R2 stay idle, the temperature adjustment processing unit (not shown) of the control unit 30 turns on (enables) the power from the fixing device 48 to the heat source 48*a* to heat the fixing roller R1, thereby increasing the surface temperature Tup.

When the surface temperature Tup is above the target temperature before rotation Tg, while the fixing roller R1 and the pressing roller R2 stay idle, the temperature adjustment processing unit (not shown) of the control unit 30 turns off (terminates) the power from the fixing device 48 to the heat source 48*a* to cool the fixing roller R1, thereby decreasing the surface temperature Tup.

In the next step, the command determination processing unit (not shown) of the control unit 30 (FIG. 3) performs the command determination process to determining whether the print command is received according to the control signal from the host device. When the command determination processing unit determines that the print command is received, the print processing unit (not shown) of the control unit 30 rotates the fixing roller R1 and the pressing roller R2, thereby starting the printing operation. When the command determination processing unit determines that the print command is not received, the idle state continues.

As described above, in the embodiment, before receiving the print command, it is controlled such that the surface temperature Tup of the fixing roller R1 becomes the target temperature before rotation Tg. Accordingly, when the fixing roller R1 and the pressing roller R2 rotate, it is possible to set the surface temperature Tup of the fixing roller R1 to the specific surface temperature Tp within the fixing enable temperature range suitable for the printing operation.

As a result, it is not necessary to perform the first warming up and the second warming up. Accordingly, when the print command is received, it is possible to reduce a period of time for starting the printing operation.

In the embodiment, during the printing operation, the estimated temperature determination processing unit may calculate the surface temperature Tcal of the fixing roller R1. Then, the temperature determination processing unit determines whether the surface temperature Tcal is within the fixing enable temperature range. Then, the temperature adjustment processing unit performs the first warming up and the second warming up.

In this case, it is controlled in advance such that the surface temperature Tup becomes the target temperature before rotation Tg. Accordingly, it is not likely that the surface temperature Tup becomes out of the fixing enable temperature range, and it is easy to set the surface temperature Tup within the fixing enable temperature range. Therefore, even when the first warming up and the second warming up are performed, it is possible to reduce a period of time for starting the printing operation.

The flowchart shown in FIG. 10 will be explained next. In step S11, the surface temperatures Tup and Tlw before rotation are detected. In step S12, the target temperature before rotation Tg is calculated. In step S13, it is determined whether the surface temperature Tup is below the target temperature before rotation Tg. When the surface temperature Tup is below the target temperature before rotation Tg, the process proceeds to step S15. When the surface temperature Tup is above the target temperature before rotation Tg, the process proceeds to step S14.

In step S14, the heat source 48*a* is turned off (terminated), thereby decreasing the surface temperature Tup. In step S15, the heat source 48*a* is turned on (enabled), thereby increasing the surface temperature Tup. In step S16, it is determined whether the print command is received. When it is determined that the print command is received, the process proceeds to step S17. When it is determined that the print command is not received, the process returns to step S11. In step S17, the printing operation is started, thereby completing the process.

Figure 11:
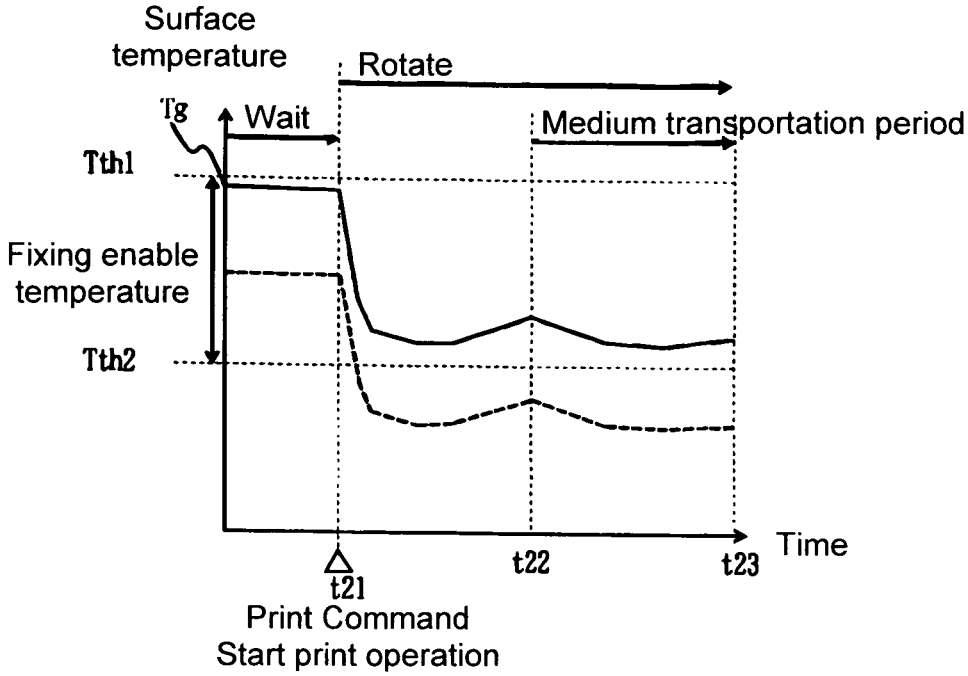
FIG. 11 is a time chart showing the operation of the printer according to the second embodiment of the present invention.

FIG. 11 is a time chart showing the operation of the printer according to the second embodiment of the present invention.

As shown in FIG. 11, while waiting for the print command, it is controlled that the surface temperature Tup of the fixing roller R1 (FIG. 1) becomes the target temperature before rotation Tg. When the print command is detected at a timing t21, the fixing roller R1 and the pressing roller R2 start rotating. Accompanying with the rotation, the surface temperature Tup decreases as indicated by a solid line. The target temperature before rotation Tg is set such that the surface temperature Tup is within the specific surface temperature Tp within the fixing enable temperature range suitable for the printing operation even though the surface temperature Tup decreases. Accordingly, when the fixing roller R1 and the pressing roller R2 start rotating at the timing t21, the print processing unit immediately performs the print process. A period of time between a timing t22 and a timing t23 represents a medium transportation period.

Note that if it is not controlled that the surface temperature Tup of the fixing roller R1 becomes the target temperature before rotation Tg, the surface temperature Tup decreases as indicated by a hidden line accompanying with the rotations of the fixing roller R1 and the pressing roller R2. As a result, the surface temperature Tup becomes out of the fixing enable temperature range.

Third Embodiment

A third embodiment of the invention will be described next. In the first and second embodiments, the fixing roller thermistor 35 (FIG. 3) as the first temperature detection unit and the pressing roller thermistor 36 as the second temperature detection unit detect the surface temperatures Tup and Tlw of the fixing roller R1 and the pressing roller R2, respectively.

In the third embodiment, it is not necessary to detect the surface temperature Tlw of the pressing roller R2 with the pressing roller thermistor 36. Components in the third embodiment similar to those in the first and second embodiments are designated by the same reference numerals, and provide effects similar to those in the first and second embodiments.

Figure 12:
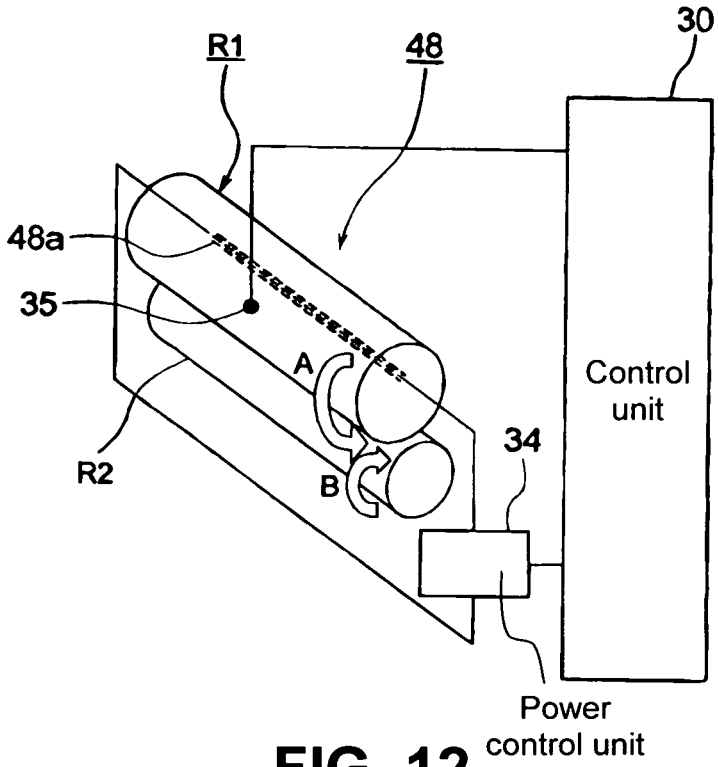
FIG. 12 is a schematic view showing a fixing device control system according to a third embodiment of the present invention.

FIG. 12 is a schematic view showing a fixing device control system according to the third embodiment of the present invention.

As shown in FIG. 12, the fixing device control system includes the fixing roller thermistor 35 of a contact type or a non-contact type as the first temperature detection unit. The fixing roller thermistor 35 is connected to the control unit 30. The heat source 48*a* as the heating member is connected to the power control unit 34. Note that the pressing roller thermistor is not provided.

Figure 13:
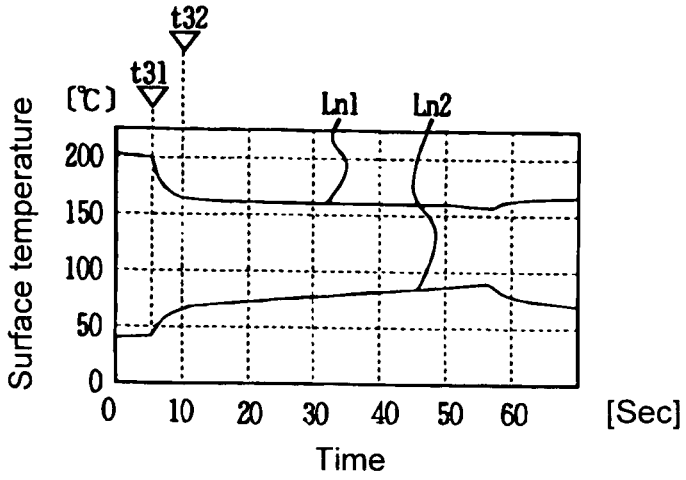
FIG. 13 is a time chart showing changes in temperatures of a fixing roller and a pressing roller according to the third embodiment of the present invention.
Figure 14:
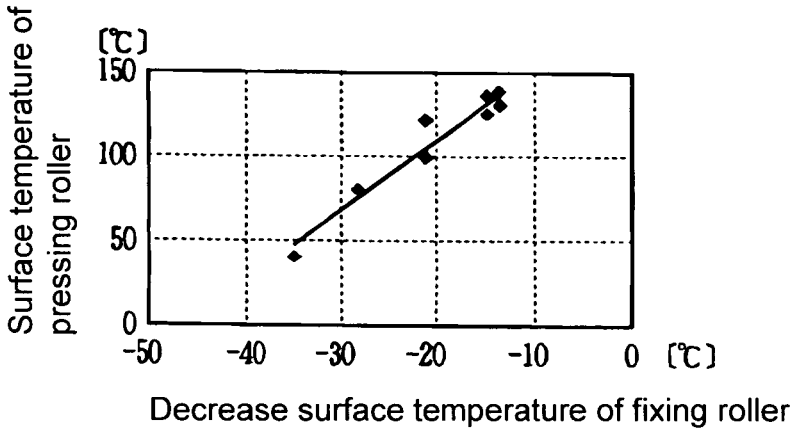
FIG. 14 is a graph showing a relationship between a decrease in a surface temperature of the fixing roller and a surface temperature of the pressing roller according to the third embodiment of the present invention.

An operation of the printer 40 will be explained next. FIG. 13 is a time chart showing changes in temperatures of the fixing roller R1 and the pressing roller R2 according to the third embodiment of the present invention. FIG. 14 is a graph showing a relationship between a decrease in the surface temperature Tup of the fixing roller R1 and the surface temperature Tlw of the pressing roller R2 according to the third embodiment of the present invention. In FIG. 14, the horizontal axis represents the decrease in the surface temperature Tup of the fixing roller R1, and the vertical axis represents the surface temperature Tlw of the pressing roller R2.

In FIG. 13, a line Ln1 represents the surface temperature Tup of the fixing roller R1 as the first rotational member, and a line Ln2 represents the surface temperature Tlw of the pressing roller R2 as the second rotational member. When the fixing roller R1 and the pressing roller R2 start rotating at a timing t31, the surface temperature Tup decreases gradually and the surface temperature Tlw increases gradually with time. In this case, the surface temperature Tup of the fixing roller R1 is greater than the surface temperature Tlw of the pressing roller R2. Accordingly, when the fixing roller R1 and the pressing roller R2 rotate, heat transfers from the fixing roller R1 to the pressing roller R2.

An experiment was conducted for obtaining the relationship between the decrease in the surface temperature Tup of the fixing roller R1 and the surface temperature Tlw of the pressing roller R2. In the experiment, the surface temperature Tup of the fixing roller R1 before rotation was detected while the surface temperature Tlw of the pressing roller R2 before rotation changed. After the fixing roller R1 and the pressing roller R2 started rotating at the timing t31, the surface temperature Tup of the fixing roller R1 was detected at a timing t32, i.e., a specific short period of time, for example, 5 seconds in the experiment.

The decrease in the surface temperature Tup of the fixing roller R1 was calculated as a difference or decrease amount ΔTup between two of the surface temperatures Tup. As a result, it was possible to obtain the relationship between the decrease amount ΔTup and the surface temperature Tlw as shown in FIG. 4.

The relationship between the decrease amount ΔTup and the surface temperature Tlw can be expressed as the following equation (4).

$$Tlw=4.17\times\Delta Tup+194 \quad (4)$$

In the embodiment, in the idle state, that is, the state before the fixing roller R1 and the pressing roller R2 start rotating, the fixing roller R1 and the pressing roller R2 rotate for 5 seconds at a specific timing. The surface temperature of the fixing roller R1 before rotation is measured as Tup1, and the surface temperature of the fixing roller R1 after rotation is measured as Tup2. Then, the decrease amount ΔTup is calculated according to the surface temperatures Tup1 and Tup2 (ΔTup=Tup1−Tup2).

According to the decrease amount ΔTup, the surface temperature Tlw of the pressing roller R2 before rotation is calculated as a most recent one. Afterward, the target temperature before rotation Tg is calculated according to the surface temperature Tlw, and it is controlled that the surface temperature Tup of the fixing roller R1 becomes the target temperature before rotation Tg. Accordingly, it is possible to improve image quality without the pressing roller thermistor, and to reduce a period of time for starting the printing operation.

Figure 15:
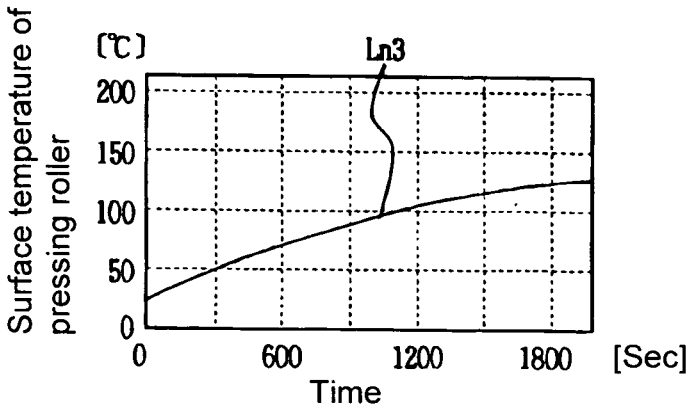
FIG. 15 is a graph showing a change in the surface temperature of the pressing roller with time according to the third embodiment of the present invention.

FIG. 15 is a graph showing a change in the surface temperature Tlw of the pressing roller R2 with time according to the third embodiment of the present invention. In FIG. 15, the horizontal axis represents time, and the vertical axis represents the surface temperature Tlw of the pressing roller R2. Further, in FIG. 15, a line Ln3 represents the change in the surface temperature Tlw of the pressing roller R2 with time when it was controlled that the surface temperature Tup of the fixing roller R1 was maintained constant while the fixing roller R1 (FIG. 3) and the pressing roller R2 stopped.

As shown in FIG. 15, the line Ln3 can be expressed by the following approximation equation (5).

$$Tlw=-0.00002\times t^2+0.08916\times t+22.1019 \quad (5)$$

where t is an elapsed time from when the pressing roller R2 started receiving heat from the fixing roller R1 (FIG. 3). Further, a start standard time (t=0) was defined as a time when the printer 40 was turned on and the fixing roller R1 started heating after the surface temperatures Tup and Tlw became equal to an environmental temperature (room temperature), for example, when the printer 40 (FIG. 2) was turned off for a long period of time. That is, in the approximation equation, as a prerequisite, the surface temperatures Tup and Tlw were equal to an environmental temperature (room temperature) at the start standard time (t=0).

In an actual case, when the printer 40 is turned on, the surface temperatures Tup and Tlw are not always equal to an environmental temperature (room temperature). For example, when the printer 40 is turned off to replace a supply after the printing operation, and the printer 40 is turned on after a few minutes, the surface temperature Tlw once increased during the printing operation might be above an environmental temperature.

In such a case, if the start standard time is defined as the time when the pressing roller R1 starts receiving heat as described above, the surface temperature Tlw calculated according to the approximation equation might be greatly different from an actual surface temperature.

In the embodiment, instead of the approximation equation shown above, the following revised approximation equation (6) is established.

$$Tlw=-0.00002\times(t+tn)^2+0.08916\times(t+tn)+22.1019 \quad (6)$$

where tn is a start standard time corresponding to a time when the printer 40 is turned on and the fixing roller R1 starts heating, or the pressing roller R2 starts receiving heat. Further, the start standard time tn corresponds to a period of time from when the surface temperature of the pressing roller R2 is substantially equal to an environmental temperature (room temperature) to when the surface temperature of the pressing roller R2 becomes Tlw through receiving heat. In other words, the start standard time tn corresponds to an advanced time from the start standard time in the approximation equation (5).

In the embodiment, after the printer 40 is turned on, it is controlled such that the surface temperature Tup of the fixing roller R1 is maintained at a constant value (for example, 200° C.). Then, the fixing roller R1 and the pressing roller R2 rotate for at a specific period of time, for example, 5 seconds. After the specific period of time, the surface temperature Tup of the fixing roller R1 is measured, and the decrease amount ΔTup is calculated as the difference in the surface temperatures.

According to the decrease amount ΔTup and the relationship shown in FIG. 14, the surface temperature Tlw of the pressing roller R2 before rotation for 5 seconds is calculated. Further, the advanced time tn is calculated from the surface temperature Tlw. Then, according to the approximation equation (6), the surface temperature Tlw of the pressing roller R2 is calculated as a most recent one. Afterward, the target temperature before rotation Tg is calculated according to the surface temperature Tlw.

Figure 16:
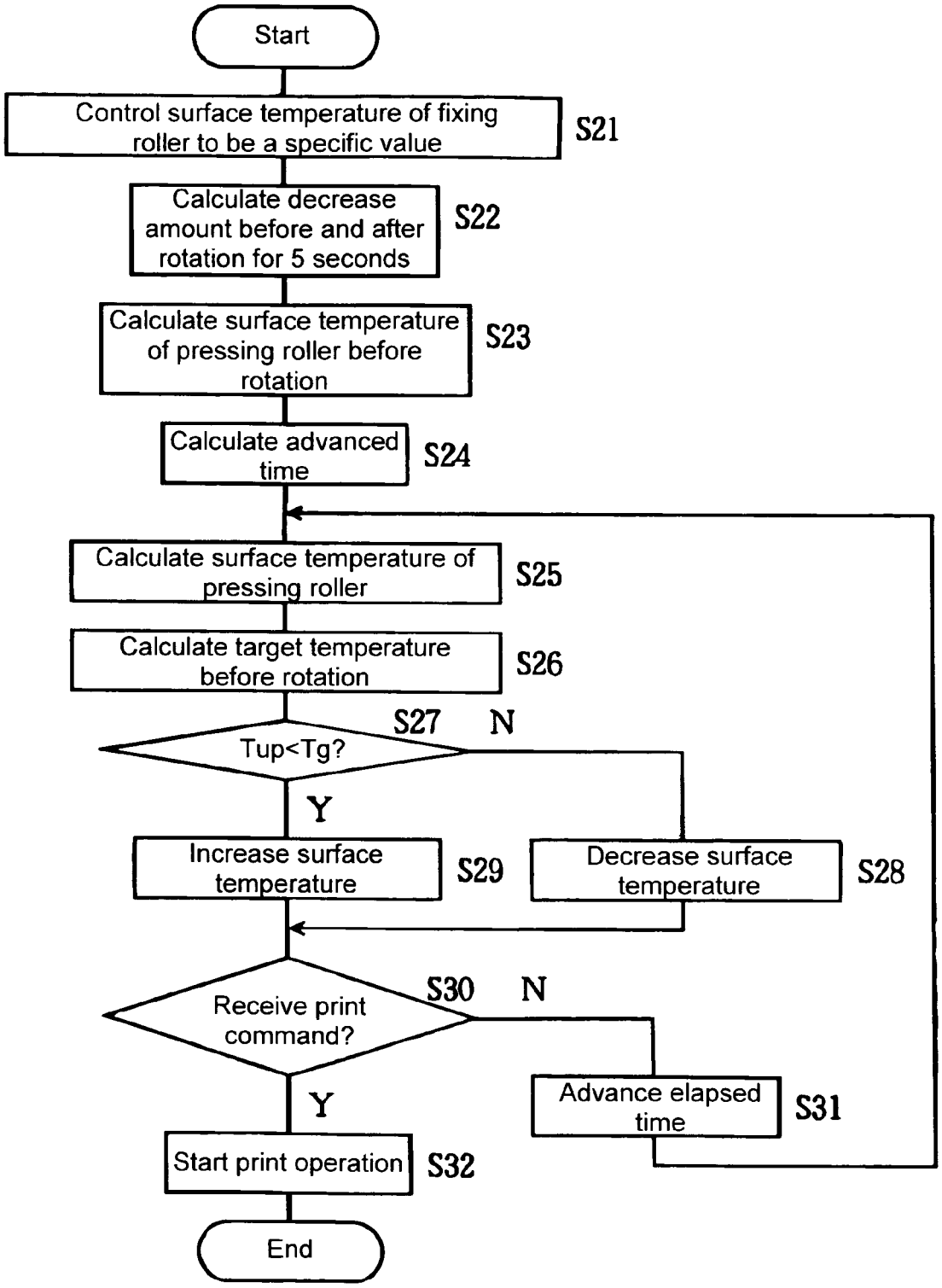
FIG. 16 is a flowchart showing an operation of a printer according to the third embodiment of the present invention.

An operation of the printer control unit will be explained next. FIG. 16 is a flowchart showing the operation of the printer according to the third embodiment of the present invention.

First, when the printer is turned on, a temperature setting processing unit (not shown) of the control unit 30 (FIG. 12) performs a temperature setting process. That is, while the fixing roller R1 and the pressing roller R2 are in the idle state, it is controlled that the surface temperature Tup of the fixing roller R1 becomes a specific value (for example, 200° C.). Then, a decrease amount calculation processing unit (not shown) of the control unit 30 performs a decrease amount calculation process. That is, the decrease amount calculation processing unit reads the surface temperature Tup of the fixing roller R1 before rotation. Than, the decrease amount calculation processing unit reads the surface temperature Tup of the fixing roller R1 at the timing of 5 seconds after the fixing roller R1 starts rotating. Accordingly, the decrease amount calculation processing unit calculates the decrease amount ΔTup as the difference between the surface temperatures Tup.

In the next step, a pressing roller surface temperature before rotation calculation processing unit (not shown) of the control unit 30 performs a pressing roller surface temperature before rotation calculation process. That is, the pressing roller surface temperature before rotation calculation processing unit calculates the surface temperature Tlw of the pressing roller R2 before rotation for 5 seconds according to the relationship between the decrease amount ΔTup and the surface temperature Tlw shown in FIG. 14, or the equation (4).

For example, when the surface temperature Tup of the fixing roller R1 is measured to be 202° C. before rotation for 5 seconds, and the surface temperature Tup of the fixing roller R1 is measured to be 165° C. after rotation for 5 seconds, the surface temperature Tlw of the pressing roller R2 is given as follows:

$$Tlw=4.17\times\Delta Tup+194=4.17\times(165-202)+194=39.7$$

In an experiment, the surface temperature Tlw of the pressing roller R2 was measured to be 40° C. Accordingly, it is possible to accurately obtain an actual surface temperature of the pressing roller R2 using the equation (4).

In the next step, an advanced time calculation processing unit (not shown) of the control unit 30 performs an advanced time calculation process. That is, the advanced time calculation processing unit calculates the advanced time tn from a specific standard time such as the start standard time (0) according to the approximation equation (6) representing the change in the surface temperature Tlw of the pressing roller R2 with time.

For example, when the surface temperature Tlw of the pressing roller R2 is calculated to be 39.7° C., the advanced time tn is given by an equation (7), i.e., a deployment form of the approximation equation (6) as follows:

$$t_n=\left(-0.06672\pm\sqrt{(0.006672^2-4*(-0.0002)*(68.78789-39.7))}\right)\Big/(2*(-0.0002))=583(\text{sec.}) \quad (7)$$

where the elapsed time t is equal to zero.

In the next step, a pressing roller surface temperature calculation processing unit (not shown) of the control unit 30 performs a pressing roller surface temperature calculation process. That is, the advanced time tn of the fixing roller R1 before rotation for 5 seconds is set as a new standard. Then, the surface temperature Tlw of the pressing roller R2 is calculated with the approximation equation (6) using the current elapsed time t as follows:

$$Tlw=-0.00002\times(t+583)^2+0.08916\times(t+583)+22.1019$$

In the next step, the target temperature calculation processing unit (not shown) of the control unit 30 performs the target temperature calculation process. More specifically, the target temperature calculation processing unit reads the surface temperature Tup of the fixing roller R1 detected with the fixing roller thermistor 35 and the surface temperature Tlw of the pressing roller R2 calculated in the pressing roller surface temperature calculation process. Then, the target temperature calculation process processing unit calculates the target temperature before rotation Tg using the equation (3).

In the next step, it is controlled such that the surface temperature Tup of the fixing roller R1 becomes the target temperature before rotation Tg. More specifically, the temperature determination processing unit (not shown) of the control unit 30 reads the surface temperature Tup and the target temperature before rotation Tg. Then, the temperature determination processing unit compares the surface temperature Tup with the target temperature before rotation Tg to determine whether the surface temperature Tup is below the target temperature before rotation Tg.

When the surface temperature Tup is below the target temperature before rotation Tg, while the fixing roller R1 and the pressing roller R2 stay idle, the temperature adjustment processing unit (not shown) of the control unit 30 turns on (enables) the power from the fixing device 48 to the heat source 48*a* to heat the fixing roller R1.

When the surface temperature Tup is above the target temperature before rotation Tg, while the fixing roller R1 and the pressing roller R2 stay idle, the temperature adjustment processing unit (not shown) of the control unit 30 turns off (terminates) the power from the fixing device 48 to the heat source 48*a* to cool the fixing roller R1.

In the next step, the command determination processing unit (not shown) of the control unit 30 (FIG. 3) performs the command determination process to determining whether the print command as the image forming command is received according to the control signal sent from the host device. When the command determination processing unit determines that the print command is received, the print processing unit (not shown) of the control unit 30 rotates the fixing roller R1 and the pressing roller R2, thereby starting the printing operation. When the command determination processing unit determines that the print command is not received, the elapsed time t advances by a unit time (for example, one second).

As described above, in the embodiment, before receiving the print command, it is controlled such that the surface temperature Tup of the fixing roller R1 becomes the target temperature before rotation Tg. Accordingly, when the fixing roller R1 and the pressing roller R2 rotate, it is possible to set the surface temperature Tup of the fixing roller R1 to the specific surface temperature Tp within the fixing enable temperature range suitable for the printing operation.

As a result, it is not necessary to perform the first warming up and the second warming up. Accordingly, when the print command is received, it is possible to reduce a period of time for starting the printing operation.

The flowchart shown in FIG. 16 will be explained next. In step S21, it is controlled that the surface temperature Tup of the fixing roller R1 become a specific value. In step S22, the decrease amount ΔTup before and after rotation for 5 seconds is calculated. In step S23, the surface temperature Tlw of the pressing roller R2 before rotation for 5 seconds is calculated. In step S24, the advanced time tn is calculated. In step S25, the surface temperature Tlw of the pressing roller R2 is calculated.

In step S26, the target temperature before rotation Tg is calculated. In step S27, it is determined whether the surface temperature Tup is below the target temperature before rotation Tg. When the surface temperature Tup is below the target temperature before rotation Tg, the process proceeds to step S29 When the surface temperature Tup is above the target temperature before rotation Tg, the process proceeds to step S28.

In step S28, the heat source 48*a* is turned off (terminated), thereby lowering the surface temperature Tup. In step S29, the heat source 48*a* is turned on (enabled), thereby increasing the surface temperature Tup. In step S30, it is determined whether the print command is received. When it is determined that the print command is received, the process proceeds to step S32. When it is determined that the print command is not received, the process returns to step S31. In step S31, the elapsed time t is advanced by the unit time, and the process returns to step S25. In step S32, the printing operation is started, thereby completing the process.

Figure 17:
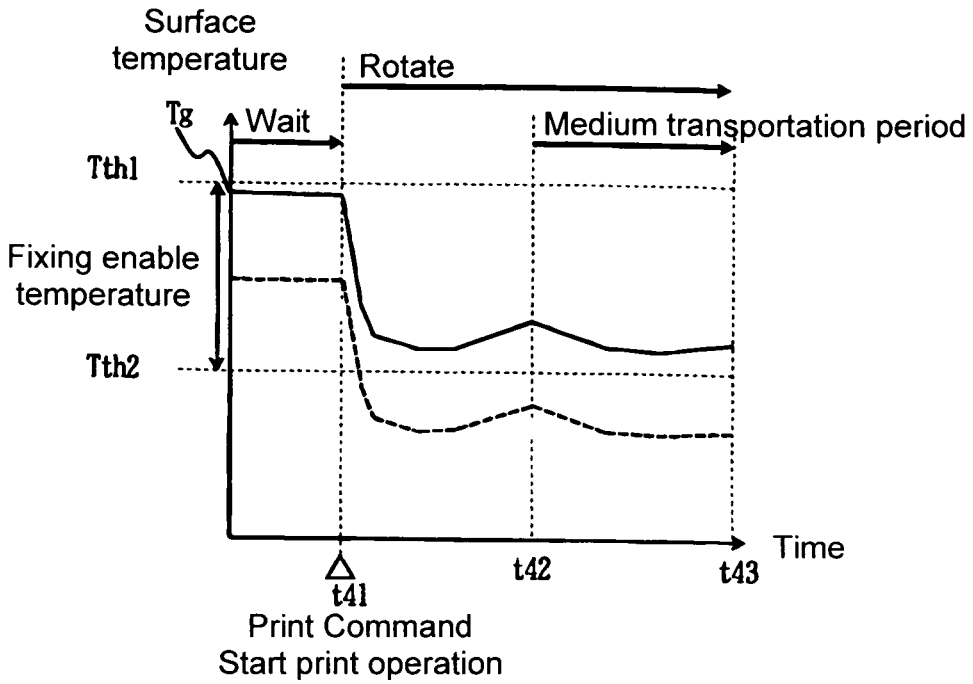
FIG. 17 is a time chart No. 1 showing an operation of the printer according to the third embodiment of the present invention.
Figure 18:
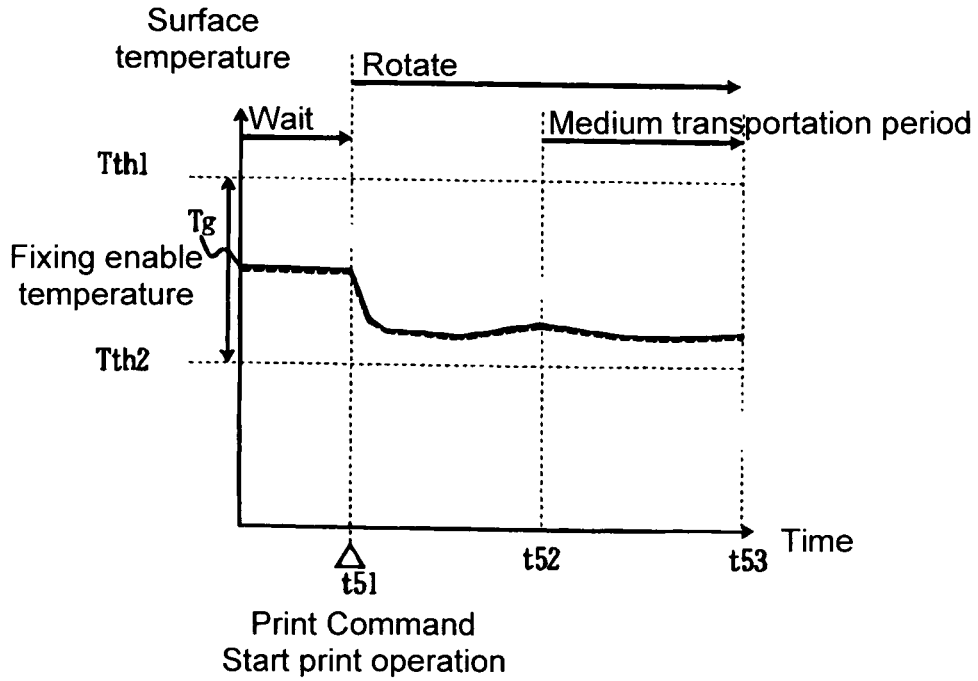
FIG. 18 is a time chart No. 2 showing the operation of the printer according to the third embodiment of the present invention.

FIG. 17 is a time chart No. 1 showing an operation of the printer according to the third embodiment of the present invention. FIG. 18 is a time chart No. 2 showing the operation of the printer according to the third embodiment of the present invention.

FIG. 17 shows a case in which the surface temperature Tlw of the pressing roller R2 (FIG. 12) is 65° C., and FIG. 18 shows a case in which the surface temperature Tlw of the pressing roller R2 is 130° C.

As shown in FIG. 17, while waiting for the print command as the image forming command, the surface temperature Tlw of the pressing roller R2 is calculated. According to the surface temperature Tlw of the pressing roller R2, it is controlled that the surface temperature Tup of the fixing roller R1 becomes the target temperature before rotation Tg. When the print command is detected at a timing t41, the fixing roller R1 and the pressing roller R2 start rotating. Accompanying with the rotation, the surface temperature Tup decreases as indicated by a solid line. The target temperature before rotation Tg is set such that the surface temperature Tup is within the specific surface temperature Tp within the fixing enable temperature range suitable for the printing operation even though the surface temperature Tup decreases. Accordingly, when the fixing roller R1 and the pressing roller R2 start rotating at the timing t41, the print processing unit immediately performs the print process. A period of time between a timing t42 and a timing t43 represents a medium transportation period.

Note that if it is not controlled that the surface temperature Tup of the fixing roller R1 becomes the target temperature before rotation Tg, the surface temperature Tup decreases as indicated by a hidden line accompanying with the rotation of the fixing roller R1 and the pressing roller R2. As a result, the surface temperature Tup becomes out of the fixing enable temperature range.

As shown in FIG. 18, when the surface temperature Tlw of the pressing roller R2 before rotation is somehow high, the target temperature before rotation Tg does not become excessively high. Accordingly, it is possible to control the surface temperature Tup of the fixing roller R1 at a proper level.

As described above, in the embodiment, the fixing roller R1 and the pressing roller R2 rotate for a specific period of time. Then, the surface temperature Tlw of the pressing roller R2 is calculated according to the decrease amount ΔTup of the surface temperature Tup of the fixing roller R1. Accordingly, it is not necessary to provide the pressing roller thermistor.

In the embodiments described above, the printer is explained as the image forming apparatus. The present invention is applicable to an image forming apparatus such as a copier, a facsimile, a multi-function product, and the likes.

The disclosure of Japanese Patent Application No. 2007-016120, filed on Jan. 26, 2007 is incorporated in the application by reference.

While the invention has been explained with reference to the specific embodiments of the invention, the explanation is illustrative and the invention is limited only by the appended claims.

What is claimed is:

1. An image forming apparatus for forming an image on a medium, comprising:

a sheet supply portion having a pick-up portion for picking up and supplying the medium to a medium transportation path;

a transportation portion for transporting the medium along the medium transportation path;

an image forming unit for charging and exposing an image supporting member to form a static latent image, and for developing the static latent image to form a developer image;

a transfer portion for transferring the developer image to the medium;

a fixing member;

a pressing member abutting against the fixing member;

a first temperature detection unit;

a second temperature detection unit;

a heating member for heating the fixing member;

a power control unit for controlling power supplied to the heating member;

a drive unit for rotating the fixing member; and a control unit for controlling the first temperature detection unit and the second temperature detection unit when the control unit receives an image forming command, wherein said control unit is arranged to control the first temperature detection to detect a first temperature of the fixing member before the fixing member starts rotating, said control unit is arranged to control the second temperature detection to detect a second temperature of the pressing member before the pressing member starts rotating, said control unit is arranged to calculate a difference between the first temperature and the second temperature before the fixing member starts rotating, said control unit is arranged to calculate an estimated temperature of the fixing member estimated to reach after the fixing member starts rotating according to the difference before the fixing member starts rotating, and said control unit is arranged to determine before the fixing member rotates whether a warming up is performed according to the estimated temperature and a fixing enable temperature range so that the estimated temperature is maintained within the fixing enable temperature range.

2. The image forming apparatus according to claim 1, wherein said control unit is arranged to control the drive unit to rotate the fixing member to start a printing operation without controlling the power control unit when the control unit determines that the warming up is not performed.

3. The image forming apparatus according to claim 2, wherein said control unit starts the printing operation when the pick-up portion picks up and supplies the medium to the medium transportation path.

4. The image forming apparatus according to claim 1, wherein said control unit is arranged to determine whether the estimated temperature of the fixing member is within the fixing enable temperature range, said control unit controlling the drive unit to rotate the fixing member and the pressing member for warming up when the control unit determines that the estimated temperature of the fixing member is not within the fixing enable temperature range.

5. The image forming apparatus according to claim 1, wherein said control unit is arranged to control the power control unit to increase the first temperature when a difference between the second temperature and a specific fixing enable temperature increases.

6. The image forming apparatus according to claim 1, wherein said control unit is arranged to calculate the estimated temperature according to the first temperature and the difference.

7. The image forming apparatus according to claim 6, wherein said control unit is arranged to calculate the estimated temperature according to the following equation:

$$Tcal=Tup-((Tup-Tlw)\times Ra)$$

where Tcal is the estimated temperature, Tup is the first temperature, Tlw is the second temperature, and Ra is a coefficient for temperature calculation after rotation.

8. The image forming apparatus according to claim 1, wherein said control unit is arranged to determine that the warming up is not performed when the estimated temperature is within the fixing enable temperature range, said control unit is arranged to determine that a first warming up is performed so that the power control unit does not supply power to the heating member and the drive unit rotates the fixing member when the estimated temperature is above the fixing enable temperature range, and said control unit is arranged to determine that a second warming up is performed so that the power control unit supplies power to the heating member and the drive unit rotates the fixing member when the estimated temperature is below the fixing enable temperature range.

* * * * *